United States Patent [19]

Eshleman

[11] Patent Number: 5,054,704

[45] Date of Patent: Oct. 8, 1991

[54] LEVEL WOUND REEL OF COMPONENT CARRIER TAPE

[75] Inventor: Ronald J. Eshleman, St. Paul, Minn.

[73] Assignee: Minnesota Mining and Manufacturing Company, St. Paul, Minn.

[21] Appl. No.: 667,343

[22] Filed: Mar. 8, 1991

Related U.S. Application Data

[63] Continuation-in-part of Ser. No. 493,440, Mar. 14, 1990, abandoned.

[51] Int. Cl.[5] ..... B65H 00/00

[52] U.S. Cl. ..... 242/1; 242/158 R; 242/DIG. 2

[58] Field of Search ..... 242/1, 158 R, DIG. 2, 242/55, 61, 71

[56] References Cited

U.S. PATENT DOCUMENTS

| | | | |
|---|---|---|---|
| 1,267,080 | 5/1918 | Judelshon | 242/DIG. 2 X |
| 1,867,596 | 7/1932 | Rosenian | 242/DIG. 2 X |
| 2,135,668 | 11/1938 | Judelshon | 242/DIG. 2 X |
| 4,352,467 | 10/1982 | Dunn et al. | 242/DIG. 2 X |
| 4,477,036 | 10/1984 | Rundo | 242/DIG. 2 X |
| 4,586,670 | 5/1986 | Vancelette et al. | 242/55 |
| 4,600,161 | 7/1986 | Barboza | 242/55 |
| 4,898,275 | 2/1990 | Skrtic et al. | 206/330 |

*Primary Examiner*—Daniel P. Stodola
*Assistant Examiner*—John P. Darling
*Attorney, Agent, or Firm*—Gary L. Griswold; Walter N. Kirn; William L. Huebsch

[57] ABSTRACT

A combination of a length of component carrier tape and a reel having a hub about which the component carrier tape is helically level wound in layers with the wraps of carrier tape in each layer being disposed edge to edge so that those wraps are displaced axially from each other by the width of the carrier tape, and with the opposite edges of wraps of carrier tape in successive layers being angled in opposite directions with respect to the axis of the hub. The peripheral surface of the hub has a minimum diameter "D" in millimeters determined by the formula:

$$D = \frac{2}{\pi} \sqrt{(7813)^2 - (7813 - W)^2}$$

where "W" is the width of the carrier tape in millimeters so that the component carrier tape should meet an industry camber specification despite cold flow which will occur in transition portions of the carrier tape between the layers.

3 Claims, 3 Drawing Sheets

14
19
11
10
22
18
28
15
31
28
30
24
26
16
20

LEVEL WOUND REEL OF COMPONENT CARRIER TAPE

CROSS REFERENCE TO RELATED APPLICATION

This is a continuation-in-part of U.S. patent application Ser. No. 07/493,440, filed Mar. 14, 1990, now abandoned.

TECHNICAL FIELD

The present invention relates to reels of component carrier tape (also called surface mount supplies carrier tape) of the type sent from the manufacturer of the carrier tape to a component manufacturer who will unwind the carrier tape from the reel and fill it with components.

BACKGROUND ART

Surface mount supplies carrier tape or component carrier tape is used to transport components (e.g., electrical components such as resistors, capacitors, or integrated circuits) from a component manufacturer to a different manufacturer that assembles the components into new products, typically by having automated assembly equipment sequentially remove components from the carrier tape and assemble them into to the new products. Such carrier tape is a polymeric strip that has been formed to have wall portions defining a series of identical pockets at predetermined uniformly spaced intervals along its length, which pockets are shaped to closely receive identical components the tape is adapted to transport (e.g., which pockets could, for example, have rectangular or generally "I" or "T" shapes in the plane of the strip, and could have flat or rounded bottoms to accommodate the shape of the components), which strip normally also has through openings uniformly spaced along one side to receive a drive sprocket by which the strip can be driven and to provide indexing holes that can be used for accurately locating the pockets along the tape with respect to assembly equipment. Typically, the carrier tape is manufactured in a first manufacturing location, wound on a reel and transported to the supplier of the components it is intended to transport. The component supplier unwinds the carrier tape from the reel, fills the pockets along the carrier tape with components, adheres a removable cover strip along the carrier tape over the component filled pockets, winds the component filled carrier tape with the attached cover strip onto a different typically smaller reel, and sends it to the user who feeds it from the reel into the assembly equipment which removes the components.

An industry standard dictates that the carrier tape must have less than 1 millimeter non cumulative camber over a length of 250 millimeters. This means that when the carrier tape is unwound from the reel on which it is shipped to the component supplier and disposed on a planar surface, its elongate edges must not deviate from being straight by more than 1 millimeter in any 250 millimeter length of the carrier tape. The component tape can easily be made to meet this specification. When the component tape is wound around a reel directly upon itself with the edges of all the wraps in a single plane for shipment to the component supplier (called "planetary winding" in the industry) it will remain generally as straight as it was when it was manufactured. Such planetary wound reels are limited in the amount of component tape they can hold, however. Thus more than one year prior to Mar. 14, 1990, the filing date of the parent application Ser. No. 07/493,440, eight millimeter wide component tape shipped to component suppliers has been supplied level wound edge to edge on reels with 203.2 millimeter (8 inch) outside diameter cores and a width (i.e., 76.2 millimeter or 3 inch) between opposed flanges on the reel that was significantly greater than the width of the carrier tape (i.e., the component carrier tape was helically level wound around the 203.2 millimeter (8 inch) diameter peripheral surface of the hub in layers with the wraps of carrier tape in each layer being disposed edge to edge so that those wraps are displaced axially from each other by the width of the carrier tape, and with the the opposite edges of wraps of carrier tape in successive layers being angled in opposite directions with respect to the axis of the hub). It has been found, however, that carrier tape supplied in this manner will not consistently meet the camber specification noted above, (even though the carrier tape as originally manufactured met that specification), and thus such level winding has not been commercially successful.

DISCLOSURE OF INVENTION

The present invention provides a planetary wound reel of carrier tape that will consistently meet the camber specification noted above, provided though the carrier tape as originally manufactured met that specification.

Applicant has recognized that the inability of eight millimeter wide component tape shipped to component suppliers level wound edge to edge on reels with 203.2 millimeter (8 inch) outside diameter cores to consistently meet the camber specification noted above (even though the carrier tape as originally manufactured met that specification) was due to cold flow that occurs after the reel is level wound with the carrier tape in transition portions of the carrier tape adjacent the flanges of the reel in which the carrier tape changes its orientation with respect to the axis of the hub between successive layers of wraps, and has found a solution to that problem.

According to the present invention there is provided a combination of a length of component carrier tape and a reel of the type described above having a hub with a peripheral surface about which the component carrier tape is helically level wound in layers with the wraps of carrier tape in each layer being disposed edge to edge so that those wraps are displaced axially from each other by the width of the carrier tape, and with the the opposite edges of wraps of carrier tape in successive layers being angled in opposite directions with respect to the axis of the hub in which the peripheral surface of the hub has a minimum diameter "D" in millimeters determined by the formula:

$$D = \frac{2}{\pi} \sqrt{(7813)^2 - (7813 - W)^2}$$

where "W" is the width of the carrier tape in millimeters.

Such a hub diameter (e.g., about 226 millimeters (8.9 inches) for 8 millimeter wide component carrier tape) should allow the component carrier tape to normally meet the camber specification noted above despite cold flow which will occur in the transition portions of the carrier tape, as will be explained in greater detail below, and meeting that specification for 8 millimeter wide component carrier tape can be virtually assured through use of even a larger preferred 355.6 millimeter (14 inch) diameter reel hub.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
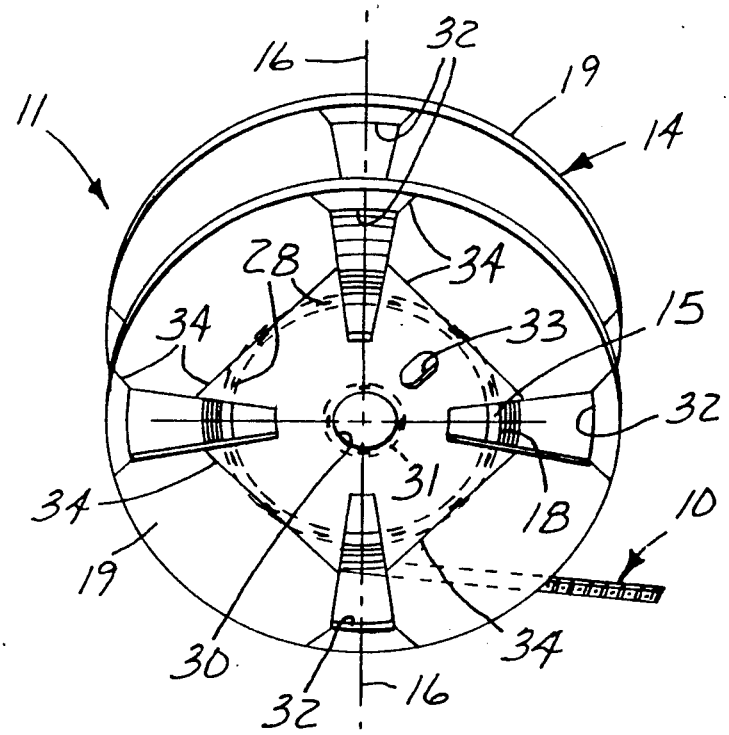
FIG. 1 is a perspective view of a combination according to the present invention of component carrier tape level wound on a reel.
Figure 2:
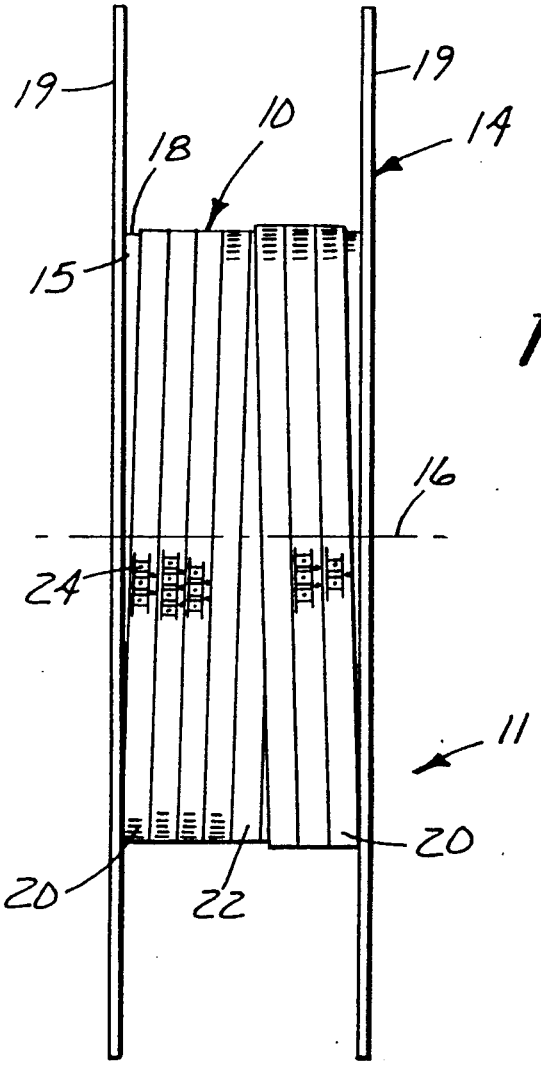
FIG. 2 is an enlarged edge view of the component carrier tape level wound on the reel that is shown in FIG. 1.
Figure 3:
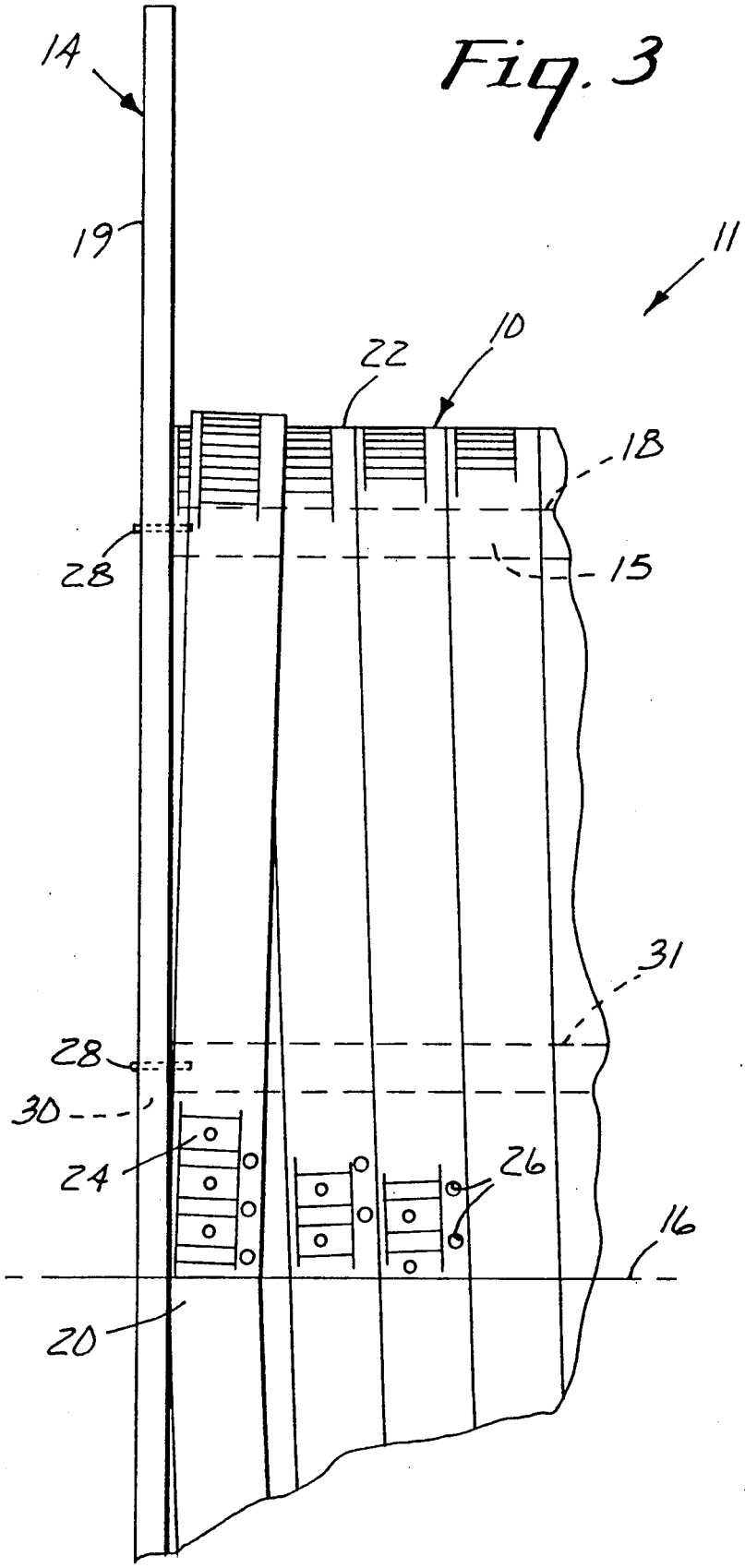
FIG. 3 is an enlarged fragmentary edge view of the component carrier tape level wound on the reel that is shown in FIG. 1.

Referring now to FIGS. 1, 2 and 3 of the drawing, there is shown a combination according to the present invention, designated by the reference numeral 11, which combination 11 generally comprises (1) a length of component carrier tape 10 having elongate edges and a uniform width between its edges; and (2) a reel 14 including a hub 15 having an axis 16, opposite axially spaced ends and a cylindrical peripheral surface 18 between its ends, and a pair of flanges 19, one fixed to the hub 15 at each of its ends and projecting radially from the hub 15, the flanges 19 having opposed inner surfaces spaced by a distance (e.g., 76.2 millimeters or greater) significantly greater than the width of carrier tape 10. The component carrier tape 10 is helically level wound around the peripheral surface 18 of the hub 15 in layers with the wraps of carrier tape 10 in each layer being disposed edge to edge so that those wraps are displaced axially from each other by the width of the carrier tape 10, with the the opposite edges of wraps of carrier tape 10 in successive layers being angled in opposite directions with respect to the axis 16 of the hub 15, and with transition portions 20 of the carrier tape 10 located adjacent the flanges 19 of the reel 14 in which transition portions 20 the carrier tape 10 changes its orientation with respect to the axis 16 of the hub 15 between successive layers of wraps. It has been found that cold flow will occur in the transition portions 20 of the carrier tape 10 shortly after the carrier tape 10 is level wound wound on the hub 15 of the reel 14 to cause camber in the carrier tape 10, and the present invention provides a sufficiently large diameter for the peripheral surface 18 of the hub 15 to minimize the amount of camber in the carrier tape 10 caused by such cold flow, as will be explained in greater detail below.

The carrier tape 10 is unitary, can be made to have a variety of uniform widths between its edges (e.g., 8, 12, 16, 24, 32 or 44 millimeters), and is made of a thin polymeric material (e.g., any thermoplastic crystalline or non crystalline material such as polyester, polycarbonate, polypropylene, styrene, butadiene, ABS plastic, etc. in the range of about 0.012 to 0.04 centimeter thick, and typically 0.025 centimeter thick) so that it is flexible. The carrier tape 10 comprises a strip like portion 22 defining a top surface for the tape 10, and wall portions defining a multiplicity of similarly shaped pockets 24 spaced along the carrier tape 10 and opening through its top surface. The wall portions may or may not include anti nesting shoulders for restricting entry of side wall portions defining the pockets 24 in one wrap of the carrier tape 10 on a reel into the pockets 24 in a wrap of carrier tape 10 beneath it as is described and claimed in U.S. Pat. No. 4,898,275 issued Feb. 6, 1990, the content whereof is incorporated herein by reference. The carrier tape 10 also has a conventional series of equally spaced and sized through openings 26 along one edge of the strip like portion 22 which will receive the teeth of a drive sprocket by which the carrier tape 10 may be driven through automated equipment which loads components into the pockets 24 or removes components from the pockets 24. Additionally, the carrier tape 10 has an opening generally centered in the bottom wall of each of the pockets 24 as is required by an industry standard to allow the presence of a component in a pocket 24 to be sensed, or to allow access for a probe that facilitates removal of a component from the pocket 24.

The hub 15 of the reel 14 is preferably a stiff hollow cylindrical tube of paper material, and the flanges 19 are preferably discs of a corrugated cardboard material attached to the ends of the hub 15 by a plurality of staples 28. The flanges 19 have central openings 30 around which are fastened the ends of a hollow cylindrical reinforcing journal tube 31 (also of paper material) extending between the flanges 19 and through which openings 30 and tube 31 a spindle may be positioned to rotatably support the reel 14. The flanges also have radially extending openings 32 that afford visual inspection of the amount of component carrier tape 10 remaining on the reel 14, and drive openings 33 adjacent the openings 30 in which an external drive member may be positioned to afford rotational driving engagement with the reel 14. The flanges 19 of the reel 14 are compressed around their peripheries to restrict engaging the edges of component carrier tape 10 being wound onto or off of the hub 15, and may also be compressed or creased along rectangularly disposed lines 34 ending in the openings 32 to afford bending portions of the flanges 19 away from the opposite flange 19 along the lines 34 to either afford visual inspection of the amount of component carrier tape 10 remaining on the reel 14, or to reduce the diameter of the reel 14 to facilitate its disposal, preferably to a recycler of paper products.

It can be estimated mathematically that in order for the component carrier tape 10 of width "W" in millimeters to be level wound on the hub 15 of the reel 14 in the manner illustrated and described with reference to FIGS. 1, 2 and 3 and so that cold flow that will occur in the transition portions 20 of the component carrier tape 10 adjacent the flanges 19 of the reel 14 will not cause the component carrier tape 10 to fail the industry standard described above (i.e., that the carrier tape 10 must have less than 1 millimeter non cumulative camber over a length of 250 millimeters) the peripheral surface 18 of the hub 15 should have a minimum diameter "D" in millimeters determined by the formula:

$$D(\text{minimum}) = \frac{2}{\pi} \sqrt{(7813)^2 - (7813 - W)^2}$$

Figure 4:
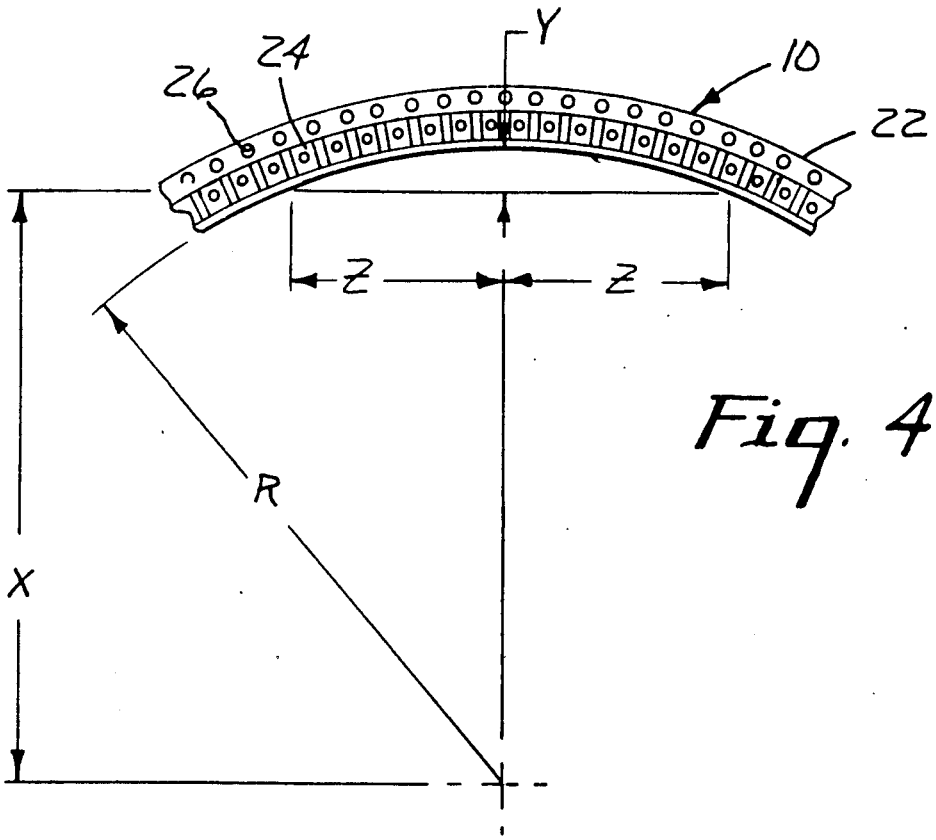
FIGS. 4 and 5 are schematic diagrams illustrating the development of a formula for the minimum diameter of a hub in the the reel of FIGS. 1, 2 and 3.
Figure 5:
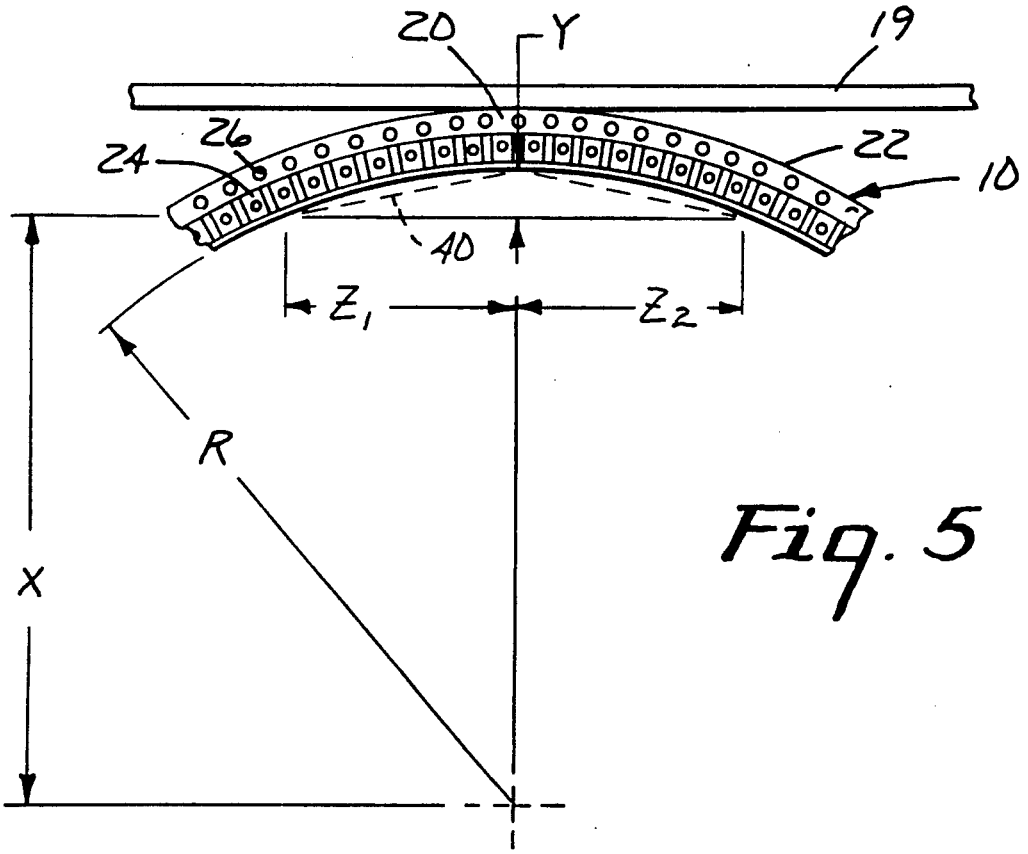

The theoretical basis for this formula, described below, is illustrated in FIGS. 4 and 5.

FIG. 4 illustrates the geometry of a length of the component carrier tape 10 having the maximum camber Y allowable under the industry standard described above (i.e., 1 millimeter camber for a 250 millimeter length) in a smooth arc having a radius R along one edge of the carrier tape 10. A portion of the carrier tape 250 millimeters long is designated by two equal lengths Z, each length Z being 125 millimeters long. The scale of the camber Y (which is 1 millimeter) is exaggerated to more clearly illustrate the geometrical relationships. The minimum camber radius R that will still meet the industry standard described above can be determined by simultaneous solution of the following equations based on the geometrical relationships illustrated in FIG. 4 using the conditions that Y=1 millimeter (i.e., the maximum allowable value for camber in 250 millimeters of the component carrier tape 10) and Z=125 millimeter (i.e., one half of the 250 millimeter length of component carrier tape represented by the cord of which Z is one half).

$$X+Y=R$$

$$X^2+Z^2=R^2$$

That simultaneous solution results in a minimum camber radius R of 7813 millimeters (25.63 feet).

FIG. 5 illustrates camber in one complete wrap of the carrier tape 10 around the hub 15 as a result of cold flow caused in one of the transition portions 20 by a change in wrapping direction of the component carrier tape 10 at the flange 19 of the reel 14 between an innermost half wrap $Z_1$ that is helically wound around the hub 15 of the reel 14 in a direction inclined axially of the reel 14 toward the flange 19 and an outer half wrap $Z_2$ that is a continuation of the innermost half wrap $Z_1$ and is helically wound around wraps of the carrier tape 10 around the hub 15 of the reel 14 in a direction inclined axially of the reel 14 away from the flange 19. The successive half wraps $Z_1$ and $Z_2$ in FIG. 5 are illustrated as though they were unwound from around the reel 14 and disposed along a plane parallel to the axis of the hub 15, and as though the camber caused in the carrier tape 10 as a result of cold flow was in a smooth arc. Thus, by comparison to FIG. 5 it can be seen that for the approximation illustrated in FIG. 5 the the following relationships, which are essentially the same as the relationships illustrated in FIG. 4, apply:

$$X+Y=R$$

$$X^2+Z_1^2=R^2$$

If R in these relationships illustrated in FIG. 5 is 7813 millimeters, (the value R determined above as illustrated in FIG. 4 which is the minimum radius of a smooth arc that can be described by the inner edge of the length of carrier tape 10 which meets the industry standard described above), and these equations are solved simultaneously for the conditions that $Z_1$ equals 0.5 $\pi$D and Y=the width W of the carrier tape, the following formula, also given above, will result.

$$D(\text{minimum}) = \frac{2}{\pi}\sqrt{(7813)^2-(7813-W)^2}$$

In the development of this formula Y is set equal to W rather than equal to 0.5 W as might be expected for Y to represent the camber of the carrier tape 10 (i.e., when the component carrier tape 10 is wound on the peripheral surface 18 of the hub 15 edge to edge, the edge of the carrier tape 10 adjacent the flange 19 at the ends of the half wraps $Z_1$ and $Z_2$ of carrier tape 10 will be displaced away from the flange 19 by an amount Y equal to about one half the width W of the tape). This setting of Y equal to W rather than equal to 0.5 W compensates for the fact that in the reel 14 level wound with the carrier tape 10, cold flow in the transition portion 20 will not cause the inner edge of the length of the carrier tape 10 to be smoothly arched as is illustrated in solid outline in FIG. 5. Rather, such cold flow will cause the inner edge of the carrier tape 10 to have more the shape of a wide V as is illustrated by a dotted outline 40 in FIG. 5 with most of the deformation caused by cold flow occurring in the transition portion 20 closely adjacent the flange 19. This localized deformation in the transition portion 20 is caused by many factors including the change in winding direction at the flange 19, the transition of the carrier tape 10 radially of the hub 15 from one winding layer to another, and compression on the transition portion 20 by outer wraps of the carrier tape 10 which compression tends to accentuate stresses in the transition portion 20 that would be partially relieved if the transition portion 20 were free to arc or twist out of the planes of the winding levels between which the transition portion 20 extends. Setting Y equal to W rather than equal to 0.5 W produces theoretical values for D (minimum) from the formula given above that, from our experience, have been good predictors of actual minimum diameters "D" for the peripheral surfaces 18 of the hubs 15 that can be level wound as described above with component carrier tape 10 of width "W" with confidence that cold flow, that will occur in the transition portions 20 of the component carrier tape 10 adjacent the flanges 19 of the reel 14, will not cause the component carrier tape 10 to fail the industry standard described above (i.e., that the carrier tape 10 must have less than 1 millimeter non cumulative camber over a length of 250 millimeters).

The use of reels 14 with the minimum diameter hubs 15 that can be determined by the above formula (e.g., about 226 millimeters (8.9 inches) for 8 millimeter (0.31 inch) wide component carrier tape; about 274 millimeters (10.8 inches) for 12 millimeter (0.47 inch) wide component carrier tape; about 317.5 millimeters (12.5 inches) for 16 millimeter (0.63 inch) wide component carrier tape; about 388.6 millimeters (15.3 inches) for 24 millimeter (0.94 inch) wide component carrier tape; about 449.6 millimeters (17.7 inches) for 32 millimeter (1.26 inch) wide component carrier tape; about 527.1 millimeters (20.7 inches) for 44 millimeter (1.73 inch) wide component carrier tape; and about 594.4 millimeters (23.4 inches) for 56 millimeter (2.2 inch) wide component carrier tape) would provide little margin for errors that might occur in level winding the carrier tape 10 onto the hub 15. Thus it is preferred to use a reel 14 that has a hub 15 diameter that is significantly above the minimum diameters indicated by the above formula, such as a reel 14 with a 355.6 millimeter (14 inch) diameter for either 8 or 12 millimeter wide component carrier tapes 10.

It is also useful to solve the formula $$D = \frac{2}{\pi} \sqrt{(R)^2 - (R - W)^2}$$

to determine R in millimeters for the hub 15 diameter D in millimeters selected for the reel 14 and the width W in millimeters of the component carrier tape 10 wound on it, and to divide the value determined for R into the minimum radius R of 7813 millimeter determined as explained above with reference to FIG. 4 to determine the percentage of that minimum radius to which the carrier tape 10 will be subjected in the selected reel. From such a calculation it will be found that 8 millimeter wide carrier tape 10 wound on the peripheral surface 18 of a 355.6 millimeter (14 inch) diameter hub 15 will be subjected to a radius of curvature that is about 40 percent of the maximum radius to which it could be subjected and still be expected to meet the industry standard described above, which provides a good safety factor; and that 12 millimeter wide carrier tape 10 wound on the peripheral surface 18 of a 355.6 millimeter (14 inch) diameter hub 15 will be subjected to a radius of curvature that is about 60 percent of the maximum radius to which it could be subjected and still be expected to meet the industry standard described above, which also provides a good safety factor.

The present invention has now been described with reference to one embodiments thereof. It will be apparent to those skilled in the art that many changes can be made in the embodiment described without departing from the scope of the present invention. Thus the scope of the present invention should not be limited to the structure described in this application, but only by structures described by the language of the claims and the equivalents of those structures.

I claim:

1. In combination, a length of component carrier tape having elongate edges, and a uniform width between said edges; and a reel including a hub having an axis, opposite axially spaced ends and a cylindrical peripheral surface between said ends, and a pair of flanges, one fixed to said hub adjacent each of said ends and projecting radially from said hub, said flanges having opposed inner surfaces spaced by a distance significantly greater than the width of said carrier tape;

said component carrier tape being helically level wound around the peripheral surface of said hub in layers with the wraps of carrier tape in each layer being disposed edge to edge so that those wraps are displaced axially from each other by the width of the carrier tape, and with the opposite edges of wraps of carrier tape in successive layers being angled in opposite directions with respect to the axis of the hub;

said peripheral surface of the hub having a minimum diameter "D" in millimeters determined by the formula:

$$D = \frac{2}{\pi} \sqrt{(7813)^2 - (7813 - W)^2}$$

where "W" is the width of the carrier tape in millimeters.

2. A combination according to claim 1 wherein the width of said carrier tape is 8 millimeters, and the diameter of said core is 355.6 millimeters (14 inches).

3. A combination according to claim 1 wherein the width of said carrier tape is 12 millimeters, and the diameter of said core is 355.6 millimeters (14 inches).

* * * * *